US007163103B2

(12) United States Patent
Bakx et al.

(10) Patent No.: US 7,163,103 B2
(45) Date of Patent: Jan. 16, 2007

(54) CARTON FOR PACKAGING FLANGED ARTICLES

(76) Inventors: Martinus C. M. Bakx, Meadwestvaco Corporation, Law Department 4850-D N. Church Ln SE, Smyrna, GA (US) 30080; Jean-Michel Auclair, Meadwestvaco Corporation, Law Department 4850-D N. Church Ln SE, Smyrna, GA (US) 30080

( * ) Notice: Subject to any disclaimer, the term of this patent is extended or adjusted under 35 U.S.C. 154(b) by 237 days.

(21) Appl. No.: 10/626,904

(22) Filed: Jul. 25, 2003

(65) Prior Publication Data

US 2005/0199513 A1 Sep. 15, 2005

Related U.S. Application Data

(63) Continuation of application No. PCT/US02/02385, filed on Jan. 26, 2002.

(30) Foreign Application Priority Data

Jan. 26, 2001 (GB) ..... 0102074.2

(51) Int. Cl.
*B65D 75/00* (2006.01)

(52) U.S. Cl. ..... 206/427; 206/429; 206/485; 206/151; 206/152; 294/87.2; 229/125.27

(58) Field of Classification Search ..... 206/427, 206/429, 485.1, 147, 151, 152, 154; 294/87.2; 229/103.2, 125.27
See application file for complete search history.

(56) References Cited

U.S. PATENT DOCUMENTS 3,164,290 A 1/1965 Paredes
3,311,402 A * 3/1967 Spandock ..... 294/87.2
3,604,614 A 9/1971 Sternfeld
3,638,990 A * 2/1972 Huault ..... 294/87.2
3,690,453 A 9/1972 Dorall
4,545,485 A * 10/1985 Oliff ..... 206/434
4,932,531 A * 6/1990 Bakx ..... 206/499
5,094,347 A * 3/1992 Schuster ..... 206/434
5,163,548 A * 11/1992 Domansky ..... 206/158
5,201,412 A * 4/1993 Schuster et al. ..... 206/153
5,230,425 A * 7/1993 Edqvist et al. ..... 206/153
5,310,051 A * 5/1994 Sutherland ..... 206/153

(Continued)

FOREIGN PATENT DOCUMENTS

FR 2298489 8/1976

(Continued)

*Primary Examiner*—Mickey Yu
*Assistant Examiner*—Steven Pollicoff
(74) *Attorney, Agent, or Firm*—Tsugihiko Suzuki

(57) ABSTRACT

A carton for packaging one or more articles, each having a laterally extending flange, includes a top wall panel, a side wall panel connected to the top wall panel, and an article retention structure with a tab formed from the side wall panel. The tab includes an upper edge for engaging the underside of the flange and an opposing lower edge defined by a pair of fold lines. The minimum distance between the top wall panel and the upper edge of the tab is less than the thickness of the flange, which causes the tab to pivot with respect to the adjacent side wall panel when the flange is received in the slit that is defined by the upper edge of the tab.

12 Claims, 14 Drawing Sheets

U.S. PATENT DOCUMENTS

| | | | | | |
|---|---|---|---|---|---|
| 5,355,999 | A | * | 10/1994 | Sutherland | 206/153 |
| 5,443,153 | A | * | 8/1995 | Sutherland | 206/152 |
| 5,611,431 | A | * | 3/1997 | Harris | 206/434 |
| 5,855,275 | A | * | 1/1999 | Hunter et al. | 206/429 |
| 6,019,220 | A | | 2/2000 | Sutherland | |

FOREIGN PATENT DOCUMENTS

| | | |
|---|---|---|
| GB | 984450 | 2/1965 |
| GB | 1275765 | 5/1972 |
| GB | 1319902 | 6/1973 |
| GB | 1340792 | 12/1973 |
| GB | 1479729 | 7/1977 |

* cited by examiner

CARTON FOR PACKAGING FLANGED ARTICLES

This is a continuation of international application No. PCT/US02/02385, filed Jan. 26, 2002, which claims priority to GB Application No. 0102074.2, filed Jan. 26, 2001, the entirety of which is hereby incorporated by reference.

BACKGROUND OF THE INVENTION

This invention relates to a carton for packaging at least one article, for example yogurt pots, having a top flange which is received by the carton. In particular, this invention relates to a carton incorporating a structure for retaining the flange.

GB 1 479 729 to Vanstone discloses a top gripping carrier having top and side panels, opposed engaging elements being struck from bevelled panels intermediate the top and side panels and being defined at their upper engaging edges by slots at their lower edges by a fold line connecting the bevelled panel. The engaging elements operate in conjunction with a connecting panel intermediate the top and side panels to engage the rim of soft drink cans and the like of reduced diameter with respect to the side wall of the cans.

U.S. Pat. No. 3,638,990 to Huault discloses a top gripping carrier for flanged articles in which a cut line extends along the majority of the intersection between the top and side panels such that the side panel, when folding downwardly and inwardly, engages the under side of the article flanges to retain the articles within the carrier.

The above mentioned carriers are adapted for particular types of article, due to the arrangement of the engaging elements and are, therefore, of limited application only.

The present invention seeks to overcome, or at least mitigate, the problems of the prior art.

SUMMARY OF THE INVENTION

One aspect of the invention provides a carton for packaging one or more articles having a laterally extending flange, the carton comprising a top wall panel, a bevelled wall panel and a side wall panel hingedly connected together in series and an article retention structure comprising a tab. The tab is formed in part from the bevelled panel and in part from the side wall panel and being defined at one edge by a slit arranged to receive a portion of the flange and at an opposing edge by first and second fold lines. The tab is adapted to be pivoted outwardly with respect to the adjacent bevelled panel to engage the underside of the flange. Preferably, the first and second fold lines may be mutually divergent towards the slit.

In one class of embodiments, the first and second fold lines may be arranged astride the fold line between the bevelled panel and the side wall panel.

Alternatively, the first and second fold lines may be formed only in the side wall panel.

According to an optional feature of this aspect of the invention, there may further comprise a vertical slit and a tear stopper slit formed at one end of the vertical slit intermediate the upper and lower edges of the tab.

A second aspect of the invention provides a carton for packaging one or more articles having a laterally extending flange. The carton comprises a top wall panel, a side wall panel and an article retention structure comprising a tab. The tab is defined at one edge by a slit arranged to receive a portion of the flange and at an opposing edge by first and second fold lines, wherein the minimum distance between the top wall and the upper edge of the tab is less than the thickness of the flange to cause the tab to be pivoted with respect to the adjacent side wall. Preferably, the first and second fold lines may be mutually divergent towards the slit.

In one class of embodiments, the slit may be substantially aligned with a third fold line interconnecting the top panel with the side panel.

Alternatively, the slit may be offset from a third fold line interconnecting the top panel with the side panel.

Optionally, the third fold line may be arranged to interconnect the top panel with the side panel.

According to an optional feature of either aspect of the invention, the first and second fold lines may be curved.

According to another optional feature of either aspect of the invention, a cut line may be provided intermediate the first and second fold lines. Preferably, the cut line may be curved.

According to another optional feature of either aspect of the invention, a further fold line may extend from the slit to one of the first and second fold lines.

According to another optional feature of either aspect of the invention, the tab may bow outwardly with respect to the article.

According to another optional feature of either aspect of the invention the side wall panel may bow inwardly with respect to the article.

According to another optional feature of either aspect of the invention, there may further comprise a portion protruding outwardly of the top panel to protect the article flange.

According to a further optional feature of either aspect of the invention there may further comprise a second side wall panel and a base wall panel thereby forming a tubular structure.

A third aspect of the invention provides a blank for forming a carton for packaging one or more articles having a laterally extending flange. The blank comprises in series a first side wall panel, a first bevel panel, a top wall panel, a second bevel wall panel and a second side wall panel hingedly connected together and an article retention structure comprising a tab. The tab is formed in part from the first bevelled panel and in part from the first side wall panel and being defined at one edge by a slit arranged to receive a portion of the flange in a set up condition and has an opposing edge by first and second fold lines. The tab is capable of pivoting outwardly with respect to the adjacent bevelled panel to engage the underside of the flange. Preferably, the first and second fold lines may be mutually divergent towards the slit. More preferably, the first and second fold lines may be arranged astride the fold line between the bevelled panel and the side wall panel.

According to an optional feature of the third aspect of the invention the divergent fold lines may be formed only in the side wall panel.

According to another optional feature of the third aspect of the invention, there may further comprise a vertical slit and a tear stopper slit formed at one end of the vertical slit intermediate the upper and lower edges of the tab.

A fourth aspect of the invention provides a blank for forming a carton for packaging one or more articles having a laterally extending flange. The blank comprises a top wall panel, a side wall panel and an article retention structure comprising a tab. The tab is defined at one edge by a cut line arranged to receive the flange and at an opposing edge by first and second fold lines, and wherein the minimum distance between the top wall and the upper edge of the tab is less than the thickness of the article flange in a set up carton. Preferably, the fold lines may be mutually divergent towards the cut line.

In one class of embodiments, the cut line may be substantially aligned with a third fold line interconnecting the top panel with the side panel.

Alternatively, the cut line may be offset from a third fold line interconnecting the top panel with the side panel.

According to an optional feature of the fourth aspect of the invention, the first and second fold lines may be curved.

According to another optional feature of the fourth aspect of the invention a further cut line may be provided intermediate the first and second fold lines. Preferably, the further cut line may be curved.

According to another optional feature of the fourth aspect of the invention a fold line may extend from the cut line to one of the first and second fold lines.

According to another optional feature of the fourth aspect of the invention there may further comprise a second side wall panel and a base wall panel.

A fifth aspect of the invention provides an article retention structure for a carton adapted to retain an article having a laterally extending flange. The retention structure comprises a tab, the tab being defined at one edge by a slit arranged to receive a portion of the flange and at an opposing edge by first and second fold lines, wherein the minimum distance between the top wall and the upper edge of the tub is less than the thickness of the article flange.

A sixth aspect of the invention provides an article retention structure for a carton adapted to retain an article having a laterally extending flange. The article retention structure comprises a tab, the tab formed in part from a beveled panel of the carton and in part from an adjacent side wall panel of the carton and being defined at one edge by a slit arranged to receive a portion of the flange and has an opposing edge by first and second fold lines, wherein the tab is adapted to be pivoted outwardly with respect to the adjacent beveled panel to engage the underside of the flange.

A seventh aspect of the invention provides a top gripping carrier and blank for forming the same comprising a top panel, downwardly extending opposed side panels and a pair of opposed engaging tabs formed respectively from the side wall panels, wherein each tab is defined at its upper engaging edge by a cut and at its lower edge at least in part by a pair of upwardly divergent fold lines and wherein the cut is virtually aligned with a fold line between the top panel and the respective side panel.

BRIEF DESCRIPTION OF THE DRAWINGS

Exemplary embodiments of the invention will now be described, by way of example only, with reference to the accompanying drawings, in which.

DETAILED DESCRIPTION OF THE PREFERRED EMBODIMENTS

Figure 1:
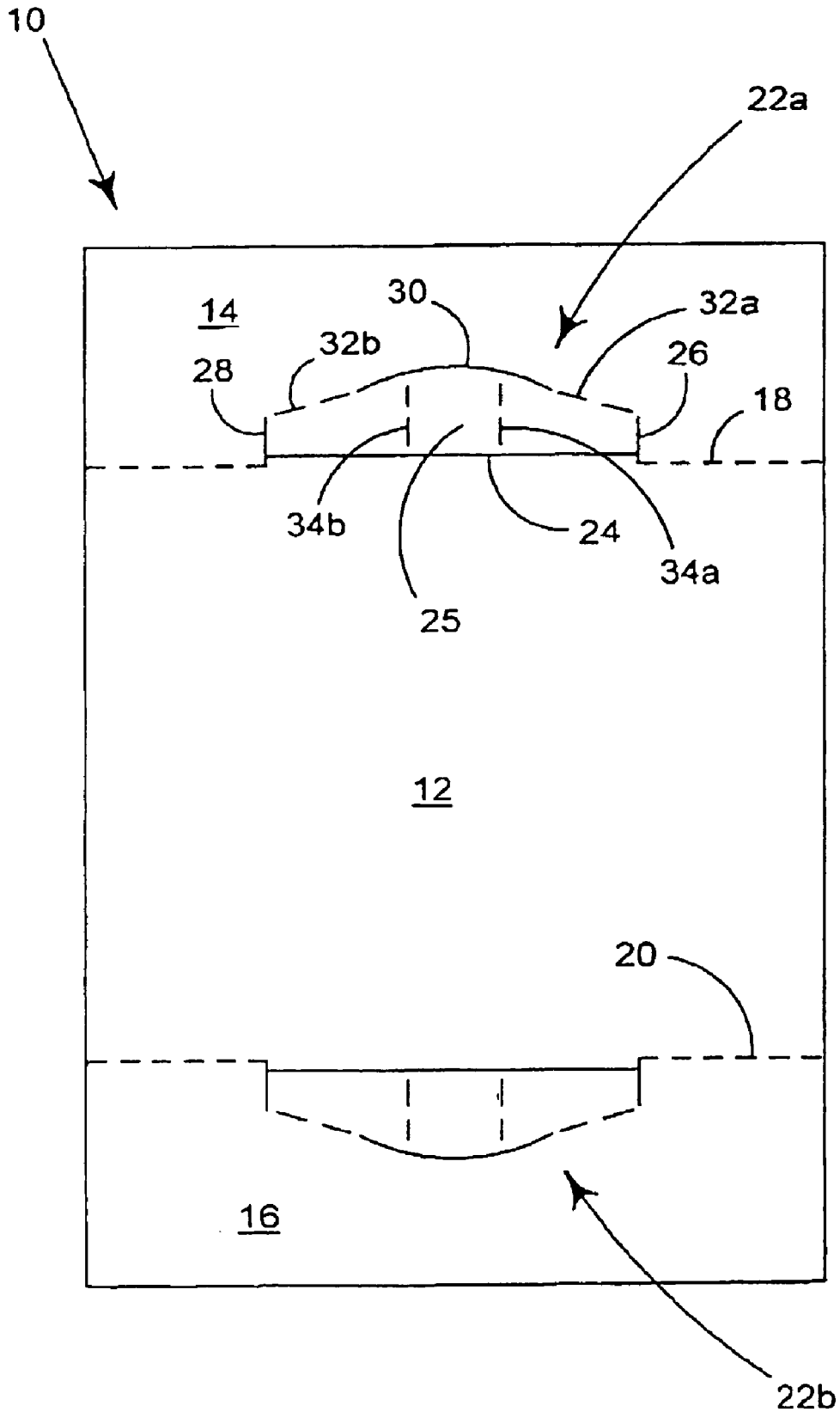
FIG. 1 is a plan view of a paperboard blank for forming an article carton according to one embodiment of the invention.

Referring first to FIGS. 1 to 6 and to FIG. 1 in particular there is shown a top gripping carton or "clip" formed from a blank 10 of paperboard or like foldable sheet material. Blank 10 comprises a central panel 12 which forms the top wall panel of the carton in use. First and second side wall panels 14 and 16 are hingedly secured to the side edges of blank 10 along interrupted fold lines 18 and 20 respectively.

In this embodiment, fold lines 18 and 20 are interrupted by article retention structures 22*a* and 22*b* struck from first and second side wall panels 14 and 16 respectively. Each structure is substantially identical, therefore only structure 22*a* is discussed in further detail below.

Article retention structure 22*a* comprises a tab 25 defined at its upper edge by first cut line 24 and at its opposed side edges by second and third cut lines 26 and 28 respectively. In this embodiment, the cut line 24 extends substantially parallel to and slightly offset from fold line 18, thereby causing a portion of top panel 12 to protrude into side panel 14. In an alternative embodiment, the first cut line 24 is co-extensive with fold line 18. In a further alternative, an aperture can be formed adjacent tab 25. In this embodiment, second and third cut lines 26 and 28 are arranged substantially at right angles first to cut line 24, define the ends of first cut line 24 and extend from fold line 18 into side wall 14.

The lower edge of tab 25 is, in this embodiment, defined by divergent, fold lines 32*a* and 32*b* arranged either side of a fourth cut line 30. Fold and cut lines 32*a*, 32*b*; 30 are preferably arranged as a continuous curved section for reasons described below. In alternative embodiments, the fold lines 32*a* and 32*b* are straight.

A pair of spaced mutually parallel fold lines 34*a* and 34*b* extend between cut lines 24 and 30. Fold lines 34*a* and 34*b* are arranged to be substantially perpendicular to fold line 24 so as to promote the bowing of tab 25 out of the plane of side panel 14 when the carton is set up as described below. In other classes of embodiment score lines are provided rather than fold lines, and it is anticipated that the number and position of such fold lines may be altered.

Turning to the construction of the carton as shown in FIGS. 2 to 5 it is envisaged that the carton of the present invention can be formed by a series of sequential folding operations in a straight line machine so that the carton is not required to be rotated or inverted to complete its construction. The folding process is not limited to that described below and may be altered according to particular manufacturing requirements.

Figure 2:
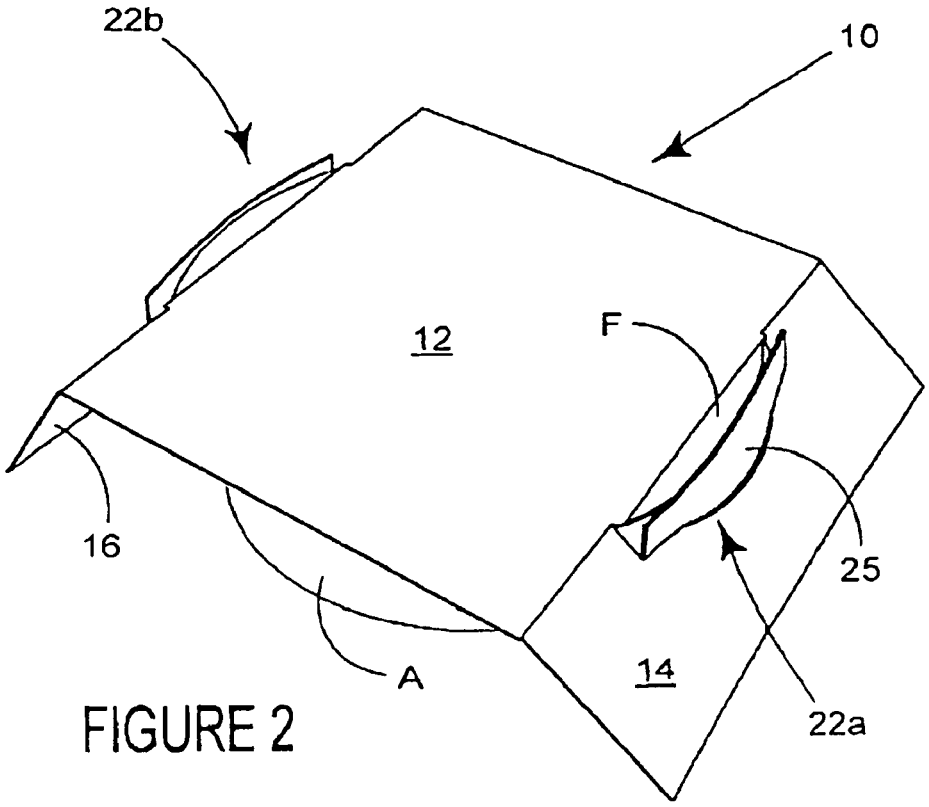
FIG. 2 is a perspective view of the blank of FIG. 1 partly formed into the carton and in which a flanged article is being introduced into the carrier.

Referring in particular to FIG. 2 the blank is placed onto an article A to be packaged such that top panel 12 overlies the lid of article A, the top panel being dimensioned such that flange portion F extends outwardly beyond fold lines 18 and 20. Side panels 14 and 16 are then folded downwardly about fold lines 18 and 20 thus initially causing tab 25 to fold outwardly about fold lines 32*a* and 32*b* due to the protruding position of flange F.

Figure 3:
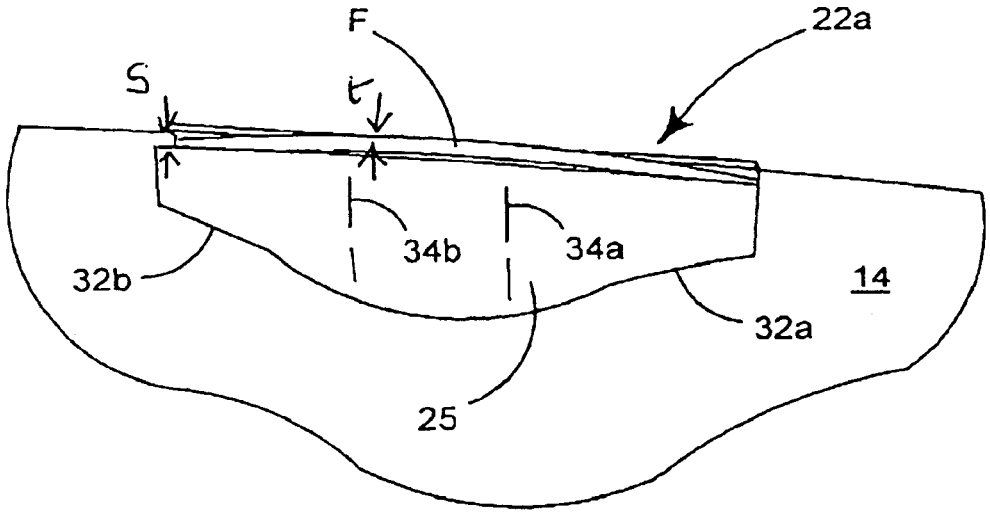
FIG. 3 is another partial perspective view of the carton partly formed.
Figure 4:
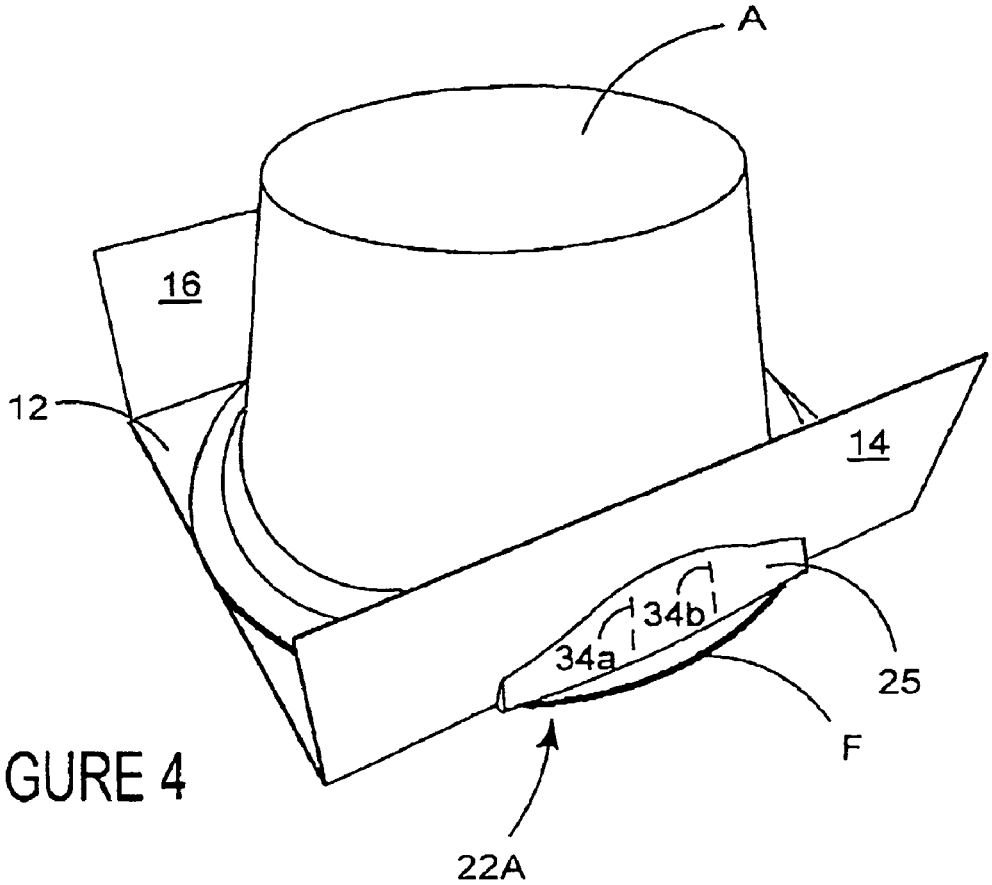
FIG. 4 is a perspective view of the carton viewed from below in a partly formed condition.

Once side panels 14 and 16 are brought into an almost perpendicular relationship with top panel 12, the free upper edge of tab 25 is automatically brought into engagement with the underside of flange F such that a portion of flange F protrudes through the slit formed by cut line 24 as illustrated in FIG. 3 and FIG. 4. As can be seen most clearly from FIG. 3, because flange F is of greater thickness T than the minimum width S of the slit, the tab 25 is caused to pivot outwardly with respect to side wall panel 14 in order to accommodate the flange F.

Figure 5:
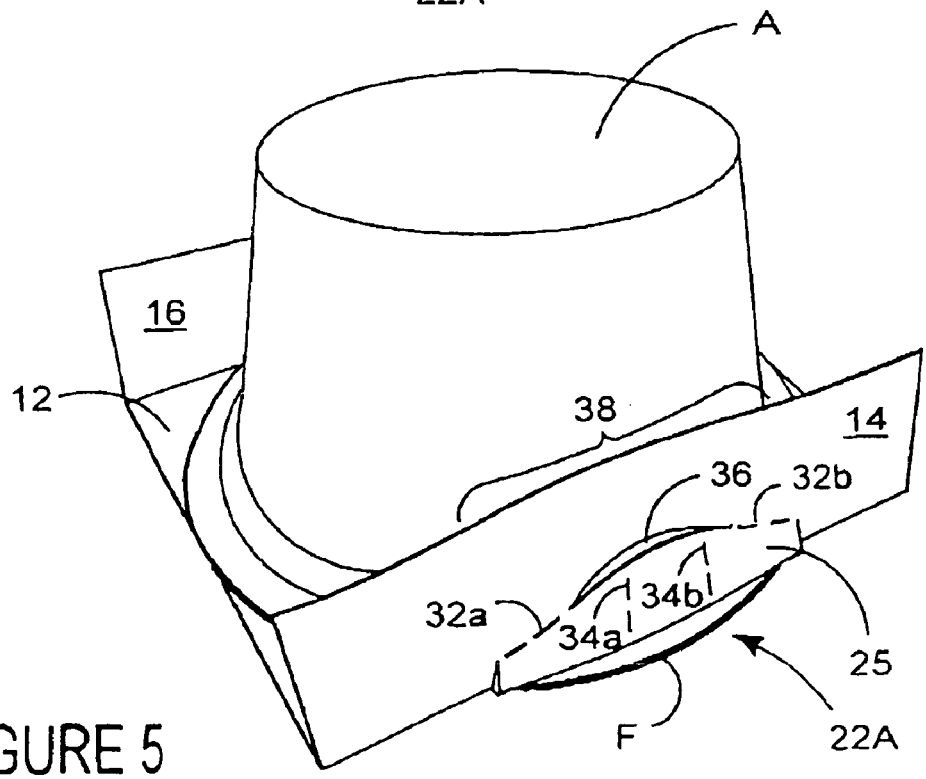
FIG. 5 is a perspective view of the completed carton.

Once side panels 14 and 16 are at rest as shown in FIG. 5, the natural tendency of the side panels to fold upwardly and resume their original position with respect to the top panel 12 causes region 38 of side panel 14 to bow inwardly whilst tab 25 bows outwardly due to the curved arrangement of fold lines 32*a* and 32*b* and cut line 30 coupled with the compression load on tab 25. This causes an aperture 36 to form between side panel 14 and tab 25 as illustrated in FIG. 5 and furthermore effectively causes tab 25 to act as a strut to counteract the tendency of side panel 14 to fold upwardly thereby to maintain the clip in a set up condition. Fold lines 34*a* and 34*b* promote the bowing of tab 25. In this embodiment, arrangement 22*b* operates in a similar manner.

Figure 6:
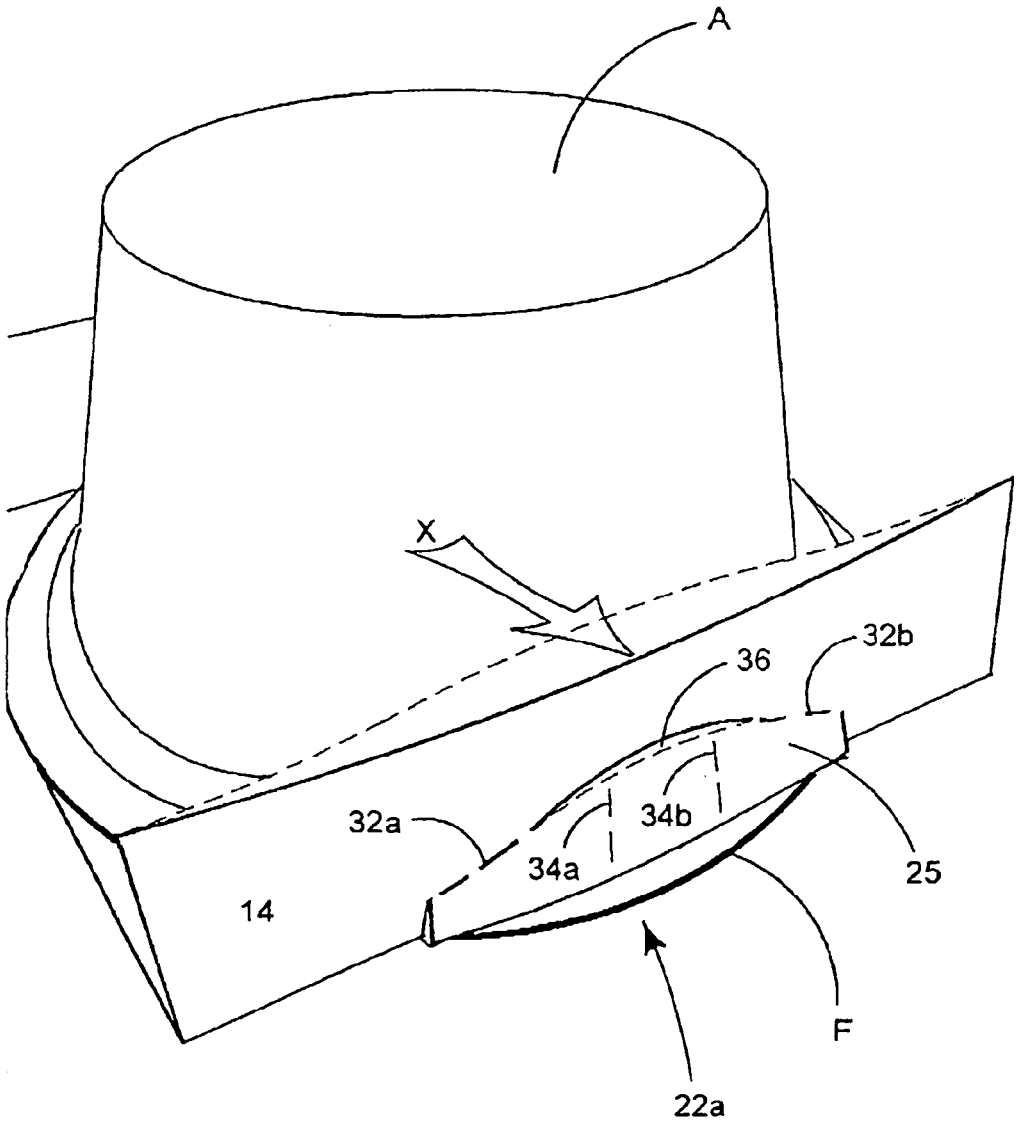
FIG. 6 is a perspective view of the completed carton illustrating the method of removal of the article therefrom.

In order to remove the carton from the article A an end user thereof engages the bowed portion of side panel 14 and folds the side panel in the direction indicated by arrow X shown in FIG. 6, thereby overcoming the "overcentre" resistance to the folding caused by the bowing of region 38 and tab 25. The side panel 14 is folded outwardly to release the article A from the tab 22.

Figure 7:
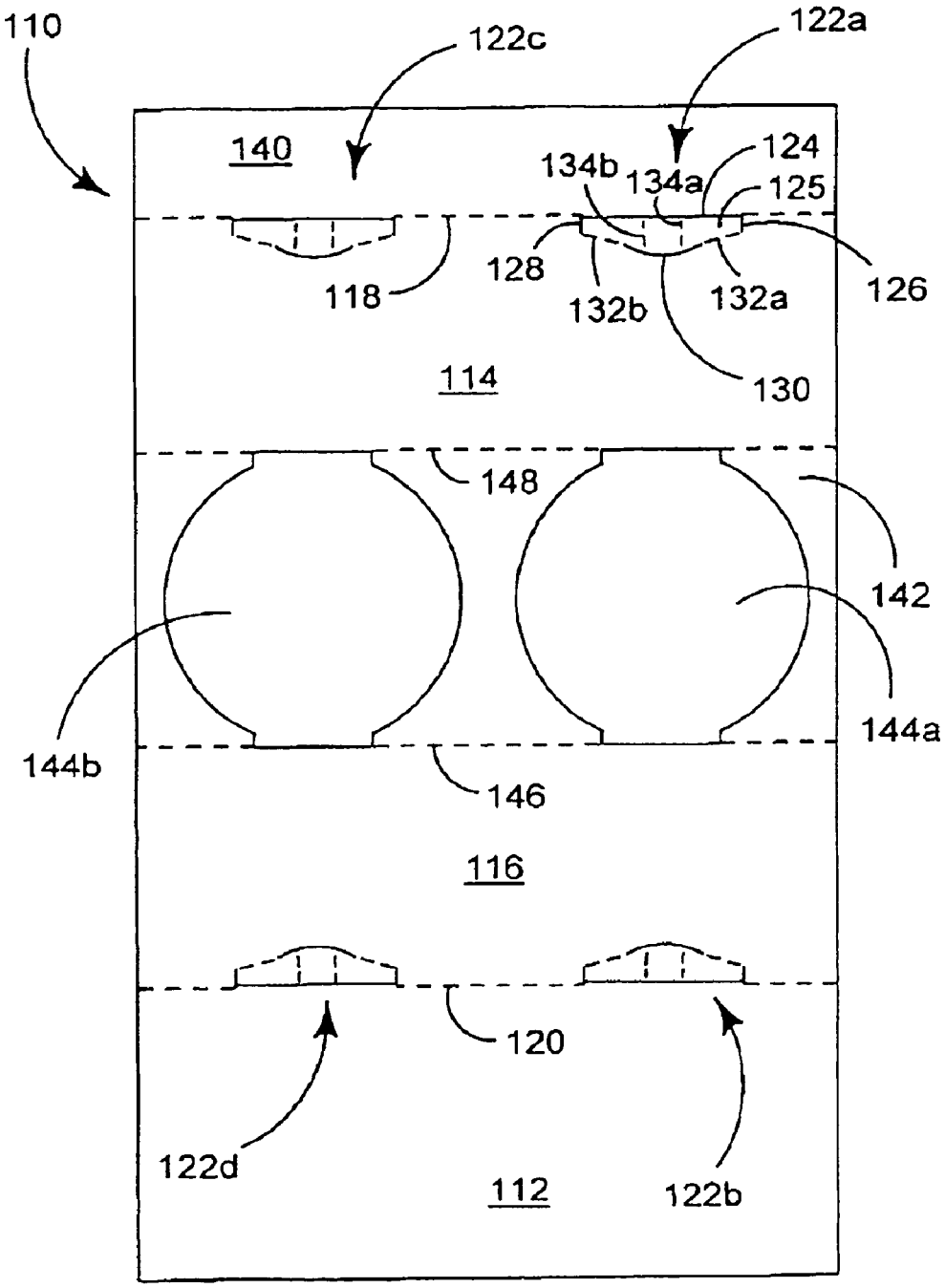
FIG. 7 is a plan view of a blank for forming a carton according to a second embodiment of the invention.
Figure 8:
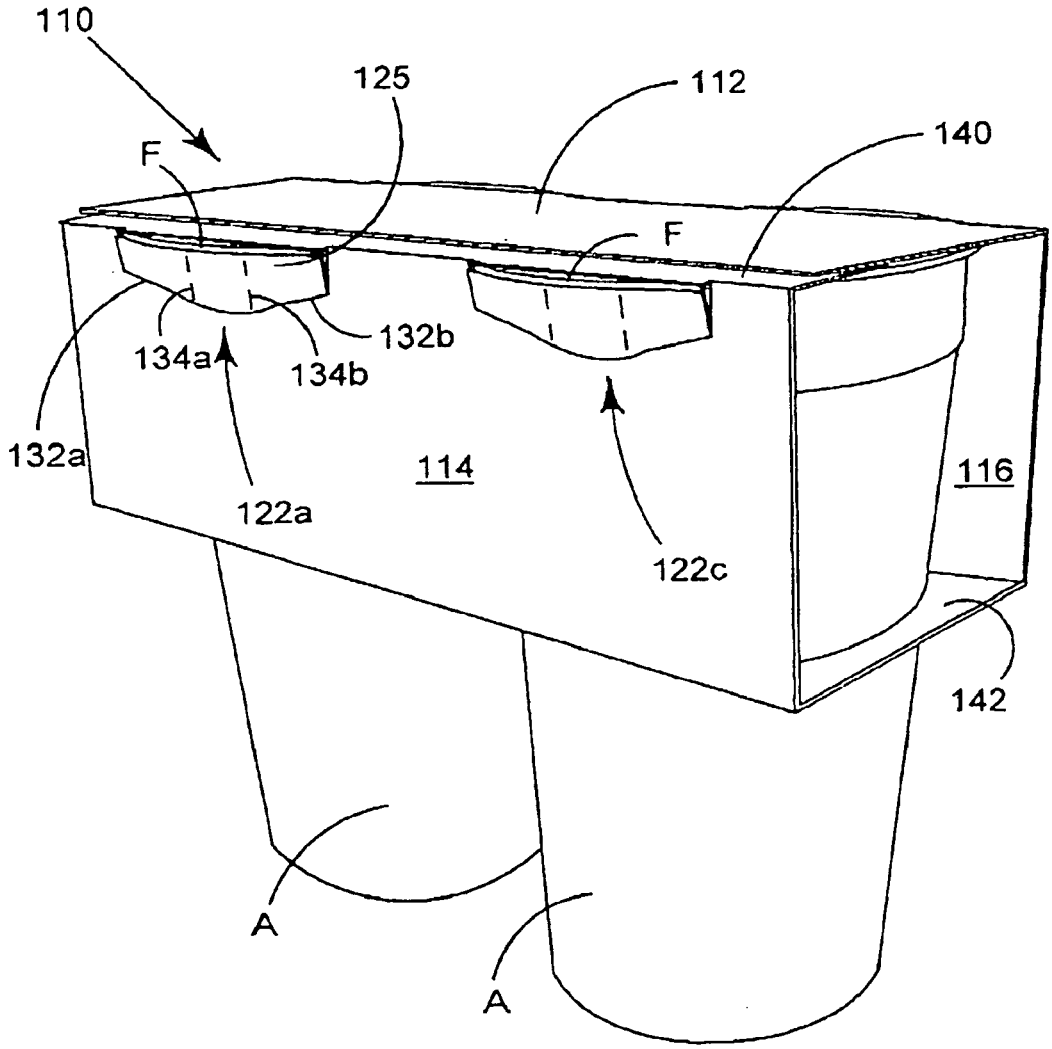
FIG. 8 is a perspective view of a completed carton formed from the blank of FIG. 7 packaging two articles.

Referring now to FIGS. 7 and 8, a second embodiment of the invention is shown in which like numerals where possible have been used for like parts with the addition of the prefix "1". The blank 110 of the second embodiment incorporates the same article retention structures 122*a*, 122*b*, 122*c* and 122*d* but is provided with four such structures in order to retain two articles A.

The blank comprises in series top wall panel 112, second side wall panel 116, base panel 142, first side wall panel 114 and securing panel 140 hingedly interconnected in series about fold lines 120, 146, 148 and 118 respectively. In this embodiment, apertures 144*a* and 144*b* are provided in base panel 142 in order to receive the main body of the articles A. It is also envisaged that in other embodiments, the blank may be dimensioned to form a full wraparound type carton to enclose both the top and base of the articles to be packaged.

Referring now to FIG. 8, the blank is again preferably set up to form a carton in a straight line machine. Articles A are first placed through apertures 144*a* and 144*b* and first and second side panels 116 and 114 are folded upwardly about fold lines 146 and 148 so as to be substantially perpendicular to base panel 142. Top panel 122 and securing flap 140 are preferably simultaneously folded inwardly about fold lines 120 and 118 such that top panel 112 is secured to flap 140 using glue or other suitable means known in the art so as to form a tubular carton as illustrated in FIG. 8. The folding process described above automatically causes the flange portions F of articles A to protrude through the slits formed by cut line 124 thereby setting up tab 125 as in the previous embodiment.

To remove articles from the carton, the end user thereof preferably separates top panel 112 from flap 140 and subsequently folds the side panels outwardly about fold lines 146 and 148 thereby releasing the flanges F from the slit. One or more articles can then be removed from the carton. If one or more articles A remain within the carton, the end user can reintroduce the flange portions F thereof through the slit, thereby enabling the articles to be effectively retained within the carton by the retention arrangements 122*a*, 122*b*, 122*c* and 122*d* as appropriate, despite the top panel 112 no longer being secured to flap 140.

Figure 9:
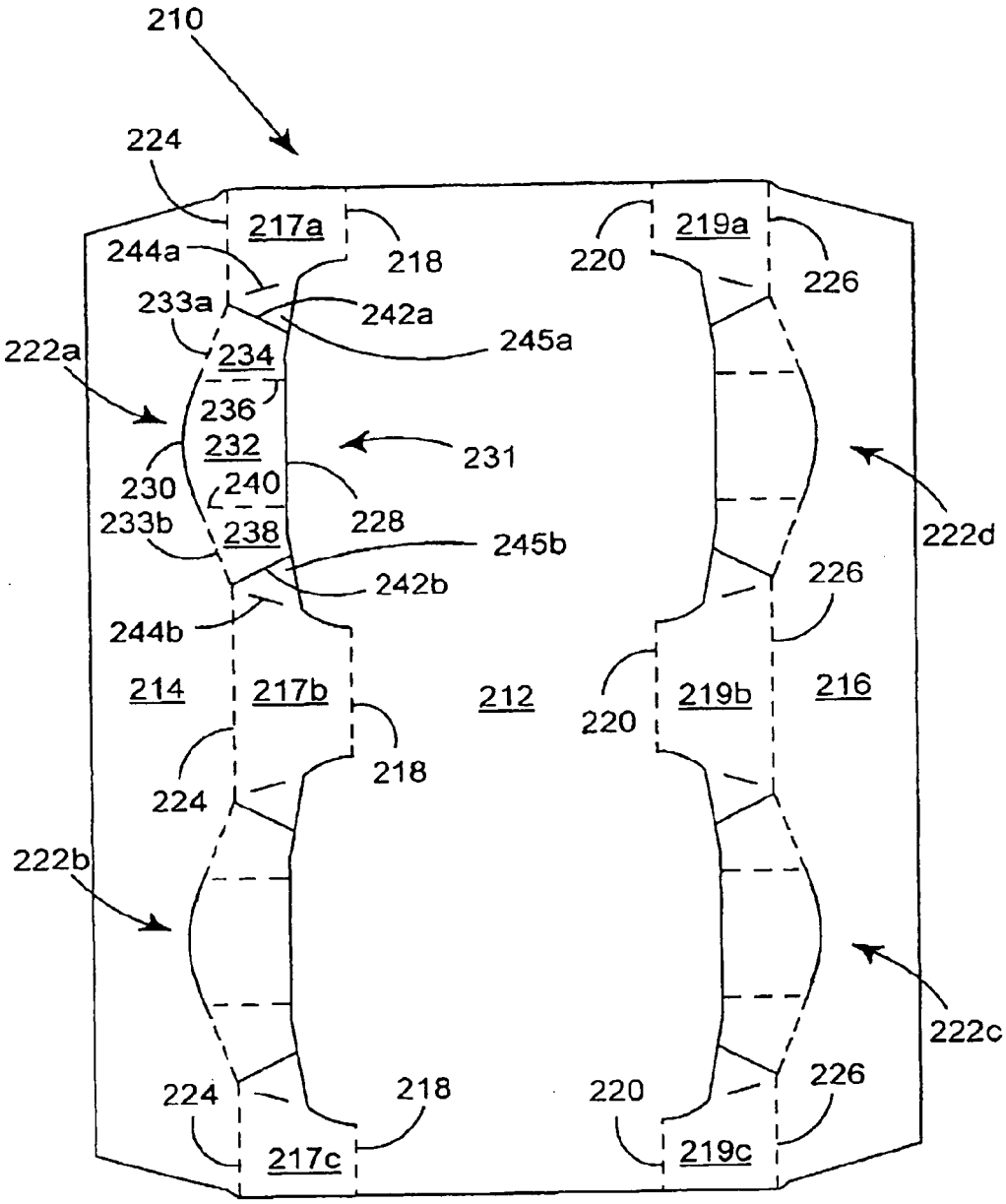
FIG. 9 is a plan view of a blank for forming an article carton according to a third embodiment of the invention.

A third embodiment is illustrated in FIG. 9 in which there is shown a top gripping clip formed from a blank 210 of paperboard or like foldable sheet material. Blank 210 is similar to the first embodiment in that there comprises a central panel 212 which forms the top wall panel of the carton, in use and first and second side wall panels 214 and 216 hingedly secured to the side edges of top panel along interrupted fold lines 218 and 220 respectively.

In this embodiment, side wall panels 214 and 216 are separated from central panel 212 by one or more retention structures 222 struck from first and second side wall panels 214 and 216 respectively and by intermediate (or beveled) panels 217 and 219 hingedly connected to side wall panels 214 and 216 respectively along fold lines 224 and 226. Beveled panels 217 and 219 are connected to central panel 212 along fold lines 218 and 220 respectively.

FIG. 9 illustrates four retention structures 222*a*, 222*b*, 222*c* and 222*d* to hold two articles, although it is envisaged that the number of structures can be altered so that one or more articles can be carried.

Each retention structure is substantially identical, therefore only structure 222*a* is discussed in further detail below. Retention structure 222*a* comprises a tab 232 defined at its upper edge by first cut line 228 and at its side edge by second and third cut lines 242 and 244. Second and third cut lines 242 and 244 extend from fold line 224 to cut line 228, in those embodiments with intermediate panels. The tab 232 is struck from the beveled panel 217 and the side wall panel 214.

Again, the cut line 224 may extend substantially parallel to and slightly offset from fold line 218, thereby causing a portion of top panel 212 to protrude into side panel 214 to define a protruding portion 231.

Similarly, the lower edge of tab 232 is, in this embodiment, defined by divergent, fold lines 233*a* and 233*b* arranged either side of a fourth cut line 230. In alternative embodiments, the fourth cut line can be dispensed with. Fold and cut lines 233*a*, 233*b*; 230 are preferably arranged as a continuous curved section for reasons described below. In alternative embodiments, the fold lines 233*a* and 233*b* are straight.

A pair of spaced mutually parallel fold lines 236 and 240 extend between cut lines 228 and 230. Fold lines 236 and 240 are arranged to be substantially perpendicular to fold line 224 so as to promote the bowing of tab 232 out of the plane of side panel 214 when the carton is set up as described below, so that tab 232 includes outer tab portions 234 and 238 that better conform to the shape of the article. In other classes of embodiment score lines are provided rather than fold lines, and it is anticipated that the number and position of such fold lines may be altered.

Of course in other embodiments, the fold lines 236, 240, 244*a* and 244*b* may be omitted from the blank without departing from the scope of invention.

There may further comprise one or more flaps 245*a*, 245*b* positioned along opposing side edges of tab 232 which flaps are able to flex out of alignment with their adjacent beveled panel 217*a* and 217*b* along fold lines 244*a* and 244*b* respectively. These flaps 245*a*, 245*b*, optionally, engage the underside of the protruding flange of the article.

Figure 10:
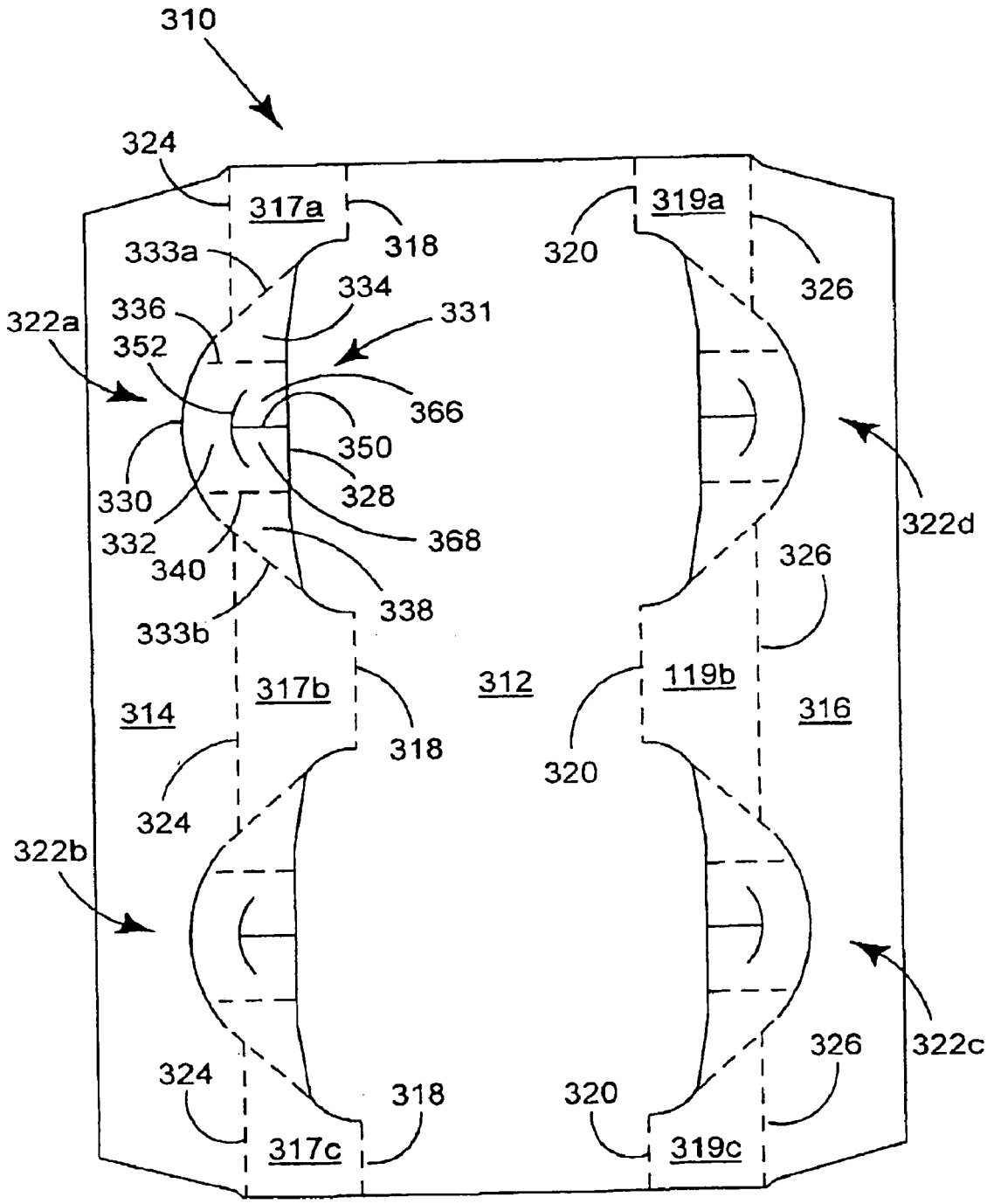
FIG. 10 is a plan view of a blank for forming an article carton according to a fourth embodiment of the invention.

Referring now to FIG. 10, a fourth embodiment of the invention is shown in which like numerals where possible have been used for like parts with the addition of the prefix "3". Therefore, only the differences will now be described in any greater detail. The blank 310 of the fourth embodiment incorporates the same retention structures 322*a*, 322*b*, 322*c* and 322*d* in order to retain two articles A.

Again, the article retention tab 322 is formed in part from the beveled panel 317 and in part from the side wall panel 314. In this embodiment, the fold lines 333*a* and 333*b* are arranged astride the fold line 324 between the beveled panel and side wall panel 314.

Thus, the outer portions 334, 338 of tab 322 are hingedly connected to the beveled panel 317 and to the side wall panel 314.

In order to improve the bowing of the tab further, there may comprise a slit 350 extending from cut line 328 into tab 322 and there may further comprise a tear stopper slit 352 at the end point of slit 350. In use, the central part 332 of tab 322 therefore comprises a pair of flap portions 366, 368 adapted to be folded outward further so that the upper edge of the tab defined by cut line 328 better conforms to the shape of the flange when the carton is in a set up condition. In addition, the tear stopper slit acts to defect stresses from the slit to prevent unwanted tearing.

Figure 11:
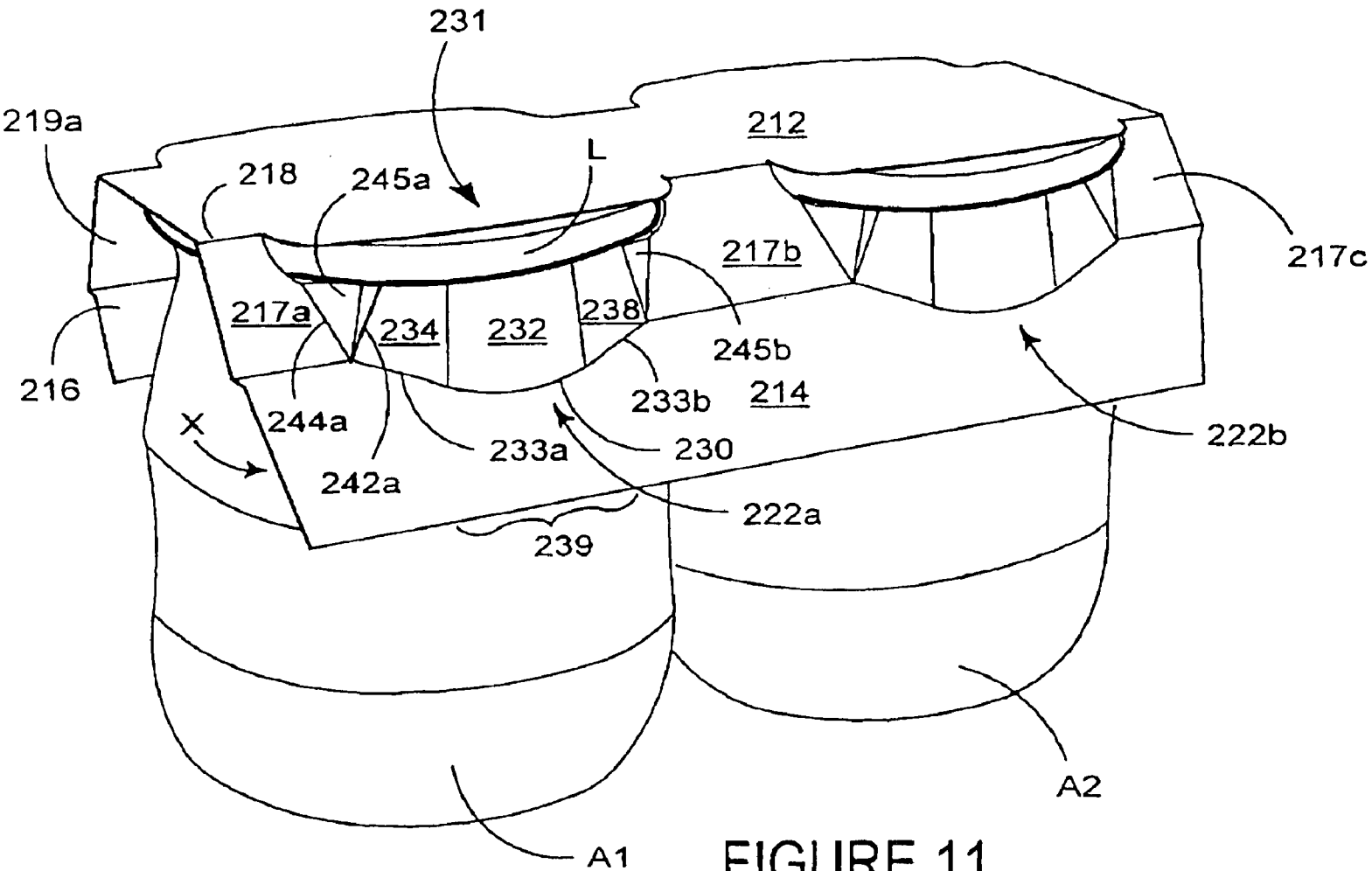
FIG. 11 is a perspective view of the blank of FIG. 9 formed into the completed carton and in which a pair of flanged articles are packaged.

Referring to the construction of the carton from the blank and in particular to FIGS. 9 to 11 the blank is placed onto one or more articles A1, A2 to be packaged such that top panel 212 overlies the lid of article A, the top panel being dimensioned such that flange portion or lip L extends outwardly beyond fold lines 218 and 220. Side panels 214 and 216 are then folded downwardly about fold lines 218 and 220 thus initially causing tab 232 to fold outwardly about fold lines 233*a* and 233*b* due to the protruding position of flange L.

At approximately the same time, the beveled panels 217 and 219 are folded out of alignment with respect to side wall panels 214 and 216 respectively along fold lines 224 and 226.

Once side panels 214 and 216 are brought into an almost perpendicular relationship with top panel 212, the free upper edge of tab 232 is automatically brought into engagement with the underside of flange L such that a portion of flange L protrudes through the slit formed by cut line 228 as illustrated in FIG. 11. As can be seen most clearly from FIG. 11, because flange F is of greater thickness than the minimum width of the slit, the tab 232 is caused to pivot outwardly with respect to side wall panel 214 along fold lines 233*a* and 233*b* in order to accommodate the flange F.

It will be seen that outer portions 234 and 238 are also folded out of alignment with respect to the central portion of tab 232 so as to better conform to the shape of the flange and, optionally, outer flaps 245*a* and 245*b* are folded along fold lines 244*a* and 244*b* respectively.

Once side panels 214 and 216 are at rest, the natural tendency of the side panels to fold upwardly and resume their original position with respect to the top panel 212 causes region 239 of side panel 214 to bow inwardly whilst tab 232 bows outwardly due to the curved arrangement of fold lines 233*a* and 233*b* and cut line 230 coupled with the compression load on tab 225. This causes an aperture (not shown) to form between side panel 214 and tab 232 and furthermore effectively causes tab 232 to act as a strut to counteract the tendency of side panel 214 to fold upwardly. In this embodiment, the article retention arrangements 222*b*, 222*c* and 222*d* operate in a similar manner.

In order to remove the carton from the article A1, A2 an end user thereof engages the bowed portion of side panel 214 and folds the side panel in the direction indicated by arrow X, thereby overcoming the "overcentre" resistance to the folding caused by the bowing of region 238 and tab 232 and the article A1, A2 is released from the clip.

Figure 12:
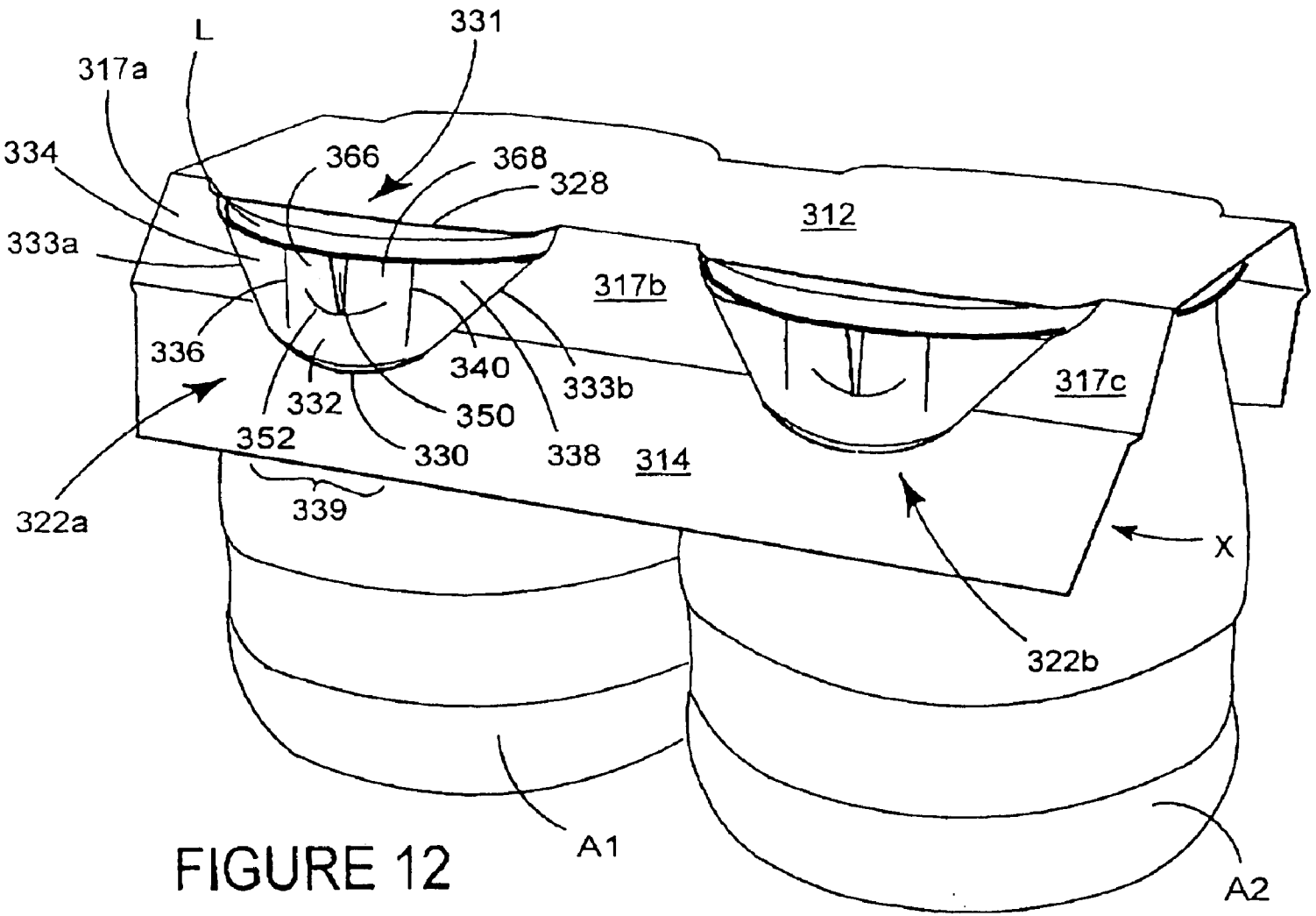
FIG. 12 is a perspective view of the blank of FIG. 10 formed into the completed carton and in which a pair of flanged article are packaged.

The carton of the fourth embodiment is constructed in a similar manner to the third embodiment whereby the blank 310 is placed onto one or more articles A1, A2 to be packaged such that the top panel 312 overlies the lid L of article A. The side wall panels 314, 316 and beveled panels 317 and 319 are folded downwardly out of alignment in an identical manner to the third embodiment which causes the tab 332 to be folded outwardly along fold lines 333*a* and 333*b*, due to the protruding position of the flange L. Once the side panels are substantially perpendicular to the top panel 312, the free upper edge of tab 332 is automatically pulled into engagement with the underside of the flange such that a portion of the flange L protrudes through the slip formed by cut lines 328, as illustrated in FIG. 12.

The tab 332 is caused to pivot outwardly along fold lines 333*a* and 333*b*, with respect to side wall panel 314 in order to accommodate the flange F. It will be seen from FIG. 12 that outer portions 334 and 338 are also folded out of alignment with respect to the central portion of tab 332 along fold lines 336 and 340 so as to better conform to the shape of the flange.

Figure 13:
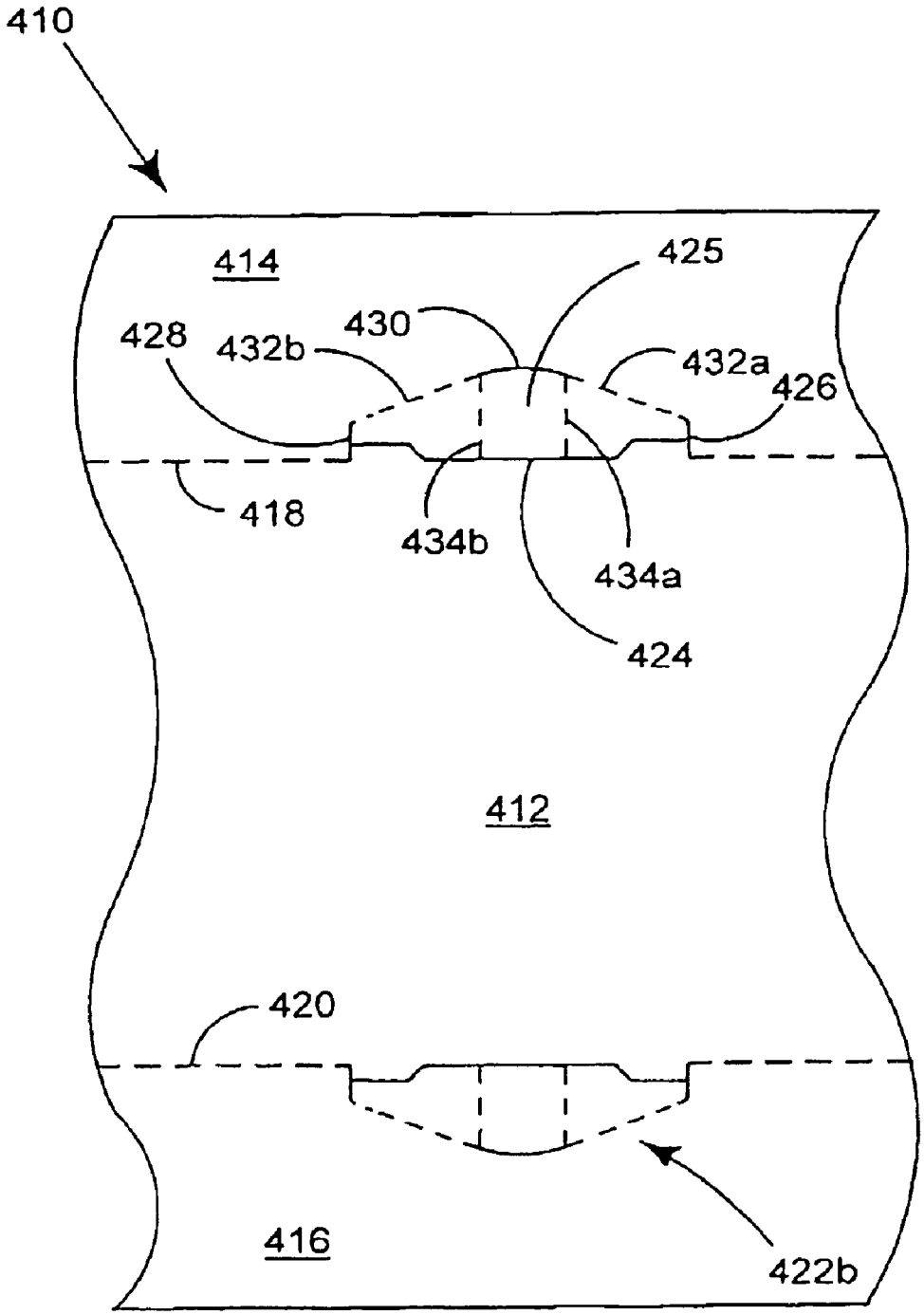
FIG. 13 is a plan view of part of a blank for forming an article carton according to a fifth embodiment of the invention.

The fifth embodiment of article retention structure is illustrated in FIG. 13 and is similar to the first embodiment shown in which like numerals where possible have been used for like parts with the addition of the prefix "4". Only the differences between the first and fifth embodiments will be described in any greater detail.

The cut line 424 is non-linear so that the slit defined once the clip is set up differs in width across its cross-section. Thus, a clip of this type would be suitable for a flange with a stepped profile or jar lid. Of course, the cut line could be a different shape according to the profile of the article flange, without departing from the scope of invention. In this embodiment, the fold lines 432*a* and 432*b* are shaped to form a continuous curve with cut line 430.

In other respects, including construction, the clip blank is identical to the first embodiment, so any reference above to the construction of the first embodiment is also applicable to this embodiment.

The sixth embodiment is described by reference to FIGS. 14 to 19. In this embodiment the blank 510 includes a plurality of pairs of article retention structures 522*a*, 522*b*, and preferably, four such structures in order to retain four articles A (FIG. 19).

The blank 510 comprises a series of panels to form a wraparound carton. Thus, there comprises, in series, an inner base wall panel 512, a first outer base wall panel 513, a first side wall panel 514, a top panel 517, a second side wall panel 516 and securing panel 515 hingedly interconnected in series about fold lines 519, 518, 520, 521 and 523 respectively. In this embodiment, four apertures 550 are provided in top panel 517 in order to receive the main body of the articles A.

The article retention structures 522 are similar to the first embodiment and shown in which like numerals where possible have been used for like parts with the addition of the prefix "5".

In this embodiment, there is no slit, due to the orientation of the articles, described in more detail below. However, the upper edge of the tab 525 is adapted to engage the upper edge of the flange, as opposed to the lower edge in the other embodiments. The tab 525 functions in the same manner as the first embodiment and is provided with the same features, and in this embodiment the upper edge of the tab 525 is offset fold line 520 or 521 as the case may be. The cut lines 526 and 528, as well as defining the end edges of tab 525, also define the edge of aperture 550.

Figure 14:
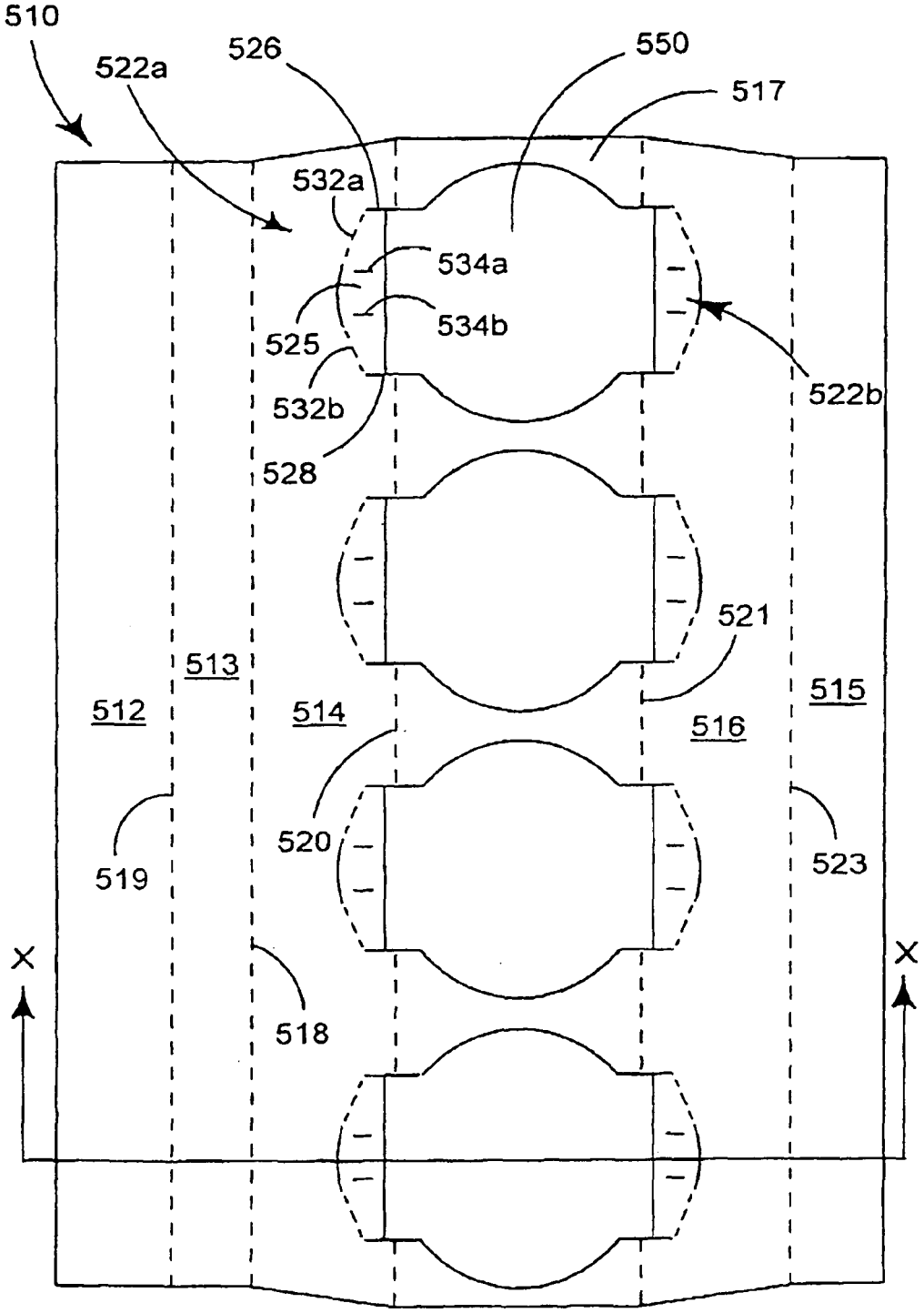
FIG. 14 is a plan view of a blank for forming an article carrier according to a sixth embodiment of the invention.
Figure 15:
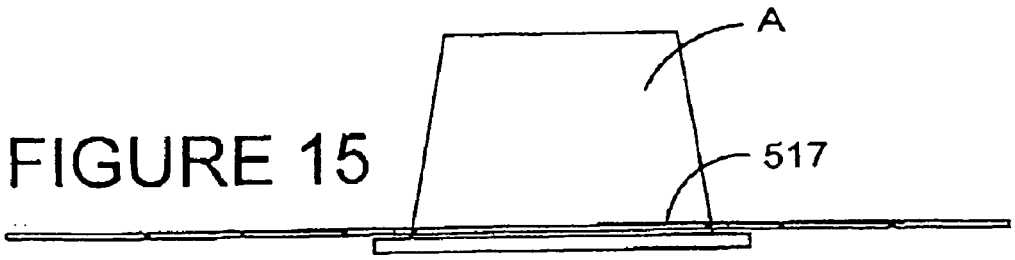
FIGS. 15 to 18 are side elevational views illustrating the various stages of construction of the carrier from the blank shown in FIG. 14.
Figure 16:
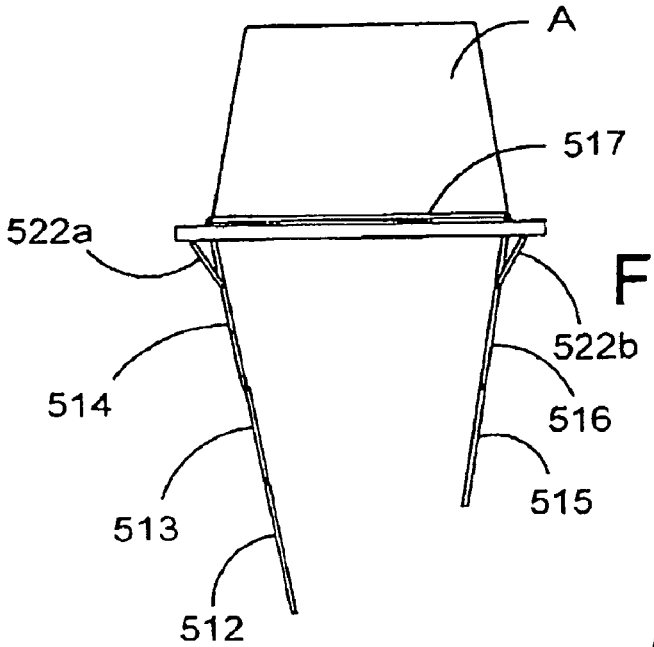
Figure 17:
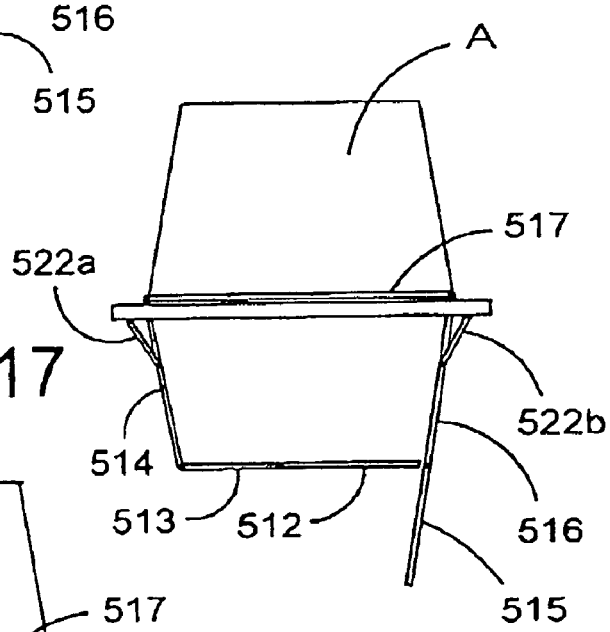
Figure 18:
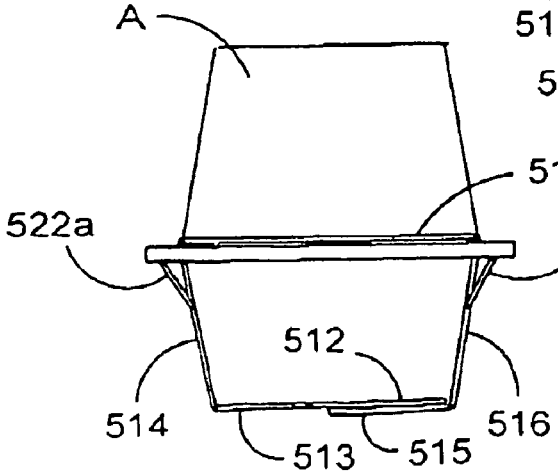
Figure 19:
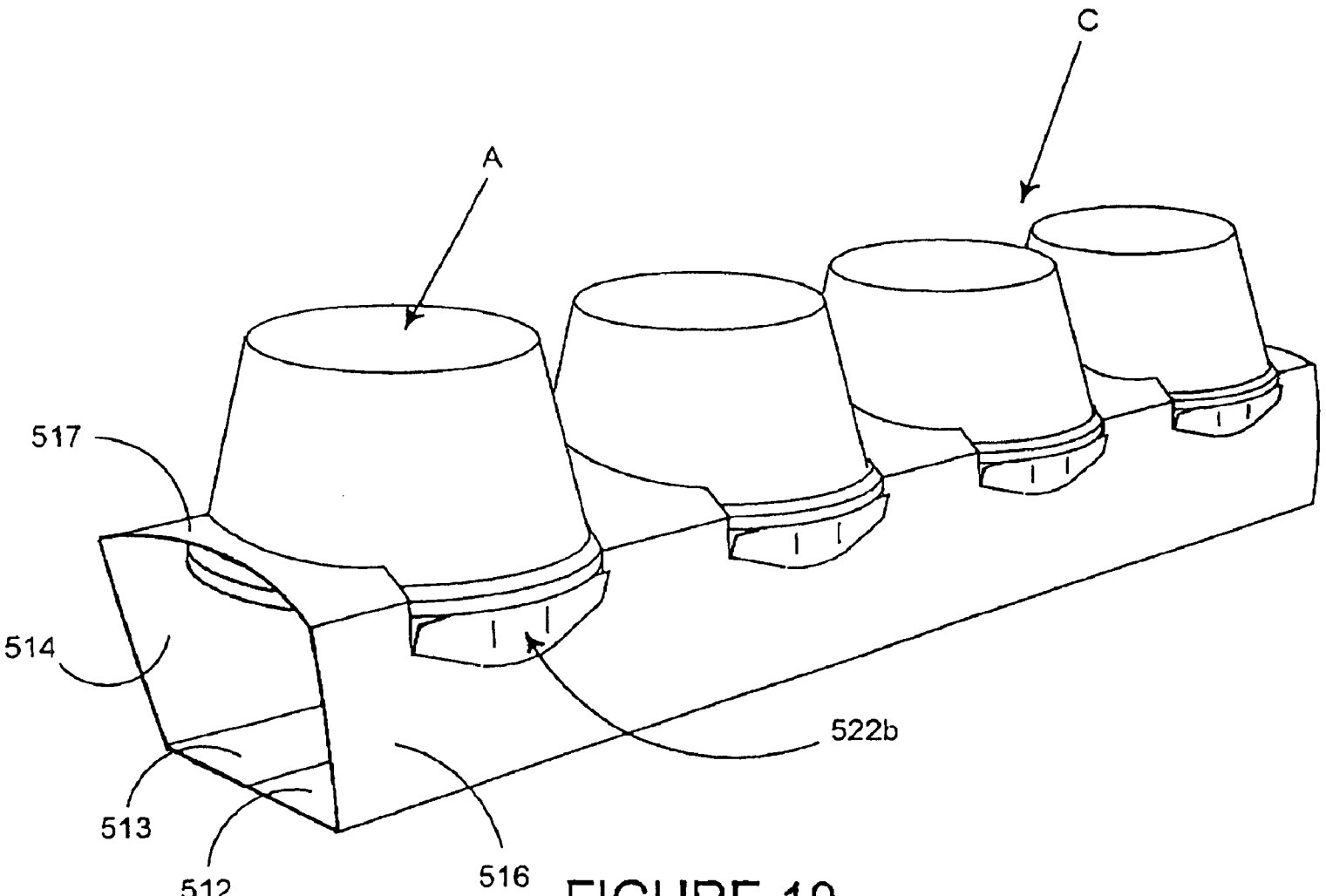
FIG. 19 is a perspective view of a completed carton formed from the blank of FIG. 14.

In order to construct the carton from the blank of FIG. 14, reference is made to FIGS. 15 to 18 in which the blank is again preferably set up to form a carton in a straight line machine. Articles A are first placed through apertures 550 by relative vertical movement between the article and blank and first and second side panels 514 and 516 are folded downwardly about fold lines 520 and 521 away from the articles so as to be slope inwardly, as shown in FIG. 16. The inner and outer base panels are then folded inwardly and secured to securing flap 515 in overlapping arrangement using glue or other suitable means known in the art so as to form a tubular carton as shown in FIGS. 17 and 18.

The folding process described above automatically causes the flange portions F of articles A to protrude through the part of apertures 550 adjacent to tab 525 to be engaged by the article retention structure 522*b*, shown in FIG. 19 and thereby setting up tab 525 as described above in more detail for the first embodiment.

To remove articles from the carton, the end user thereof preferably forces the tab 525 outwards thereby releasing the flanges F from the abutment with the retention structure. One or more articles can then be removed from the carton.

The construction of the cartons or clips from the blanks described above can be formed by a series of sequential folding operations in a straight line machine so that the carton is not required to be rotated or inverted to complete its construction. The folding process is not limited to that described above and may be altered according to particular manufacturing requirements.

It will be recognized that as used herein, directional references such as "top", "base", "end", and "side" "upper", "lower", "inner" and "outer" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

It should be recognized that numerous changes may be made within the scope of the invention. In particular, it should be apparent to a person skilled in the art that the retention arrangements described above may be applied to a wide variety of carton types for example wraparound cartons, top gripping cartons or other such cartons in which it is necessary for articles to be packaged having flange portions to be retained without the use of glue or other known means. The position of the retention structure may be adjusted to accommodate articles having flanges at locations other than at the ends of the carton.

What is claimed is:

1. A carton for packaging one or more articles having a laterally extending flange, the carton comprising:

a top wall panel;

a side wall panel connected to the top wall panel; and an article retention structure comprising:

a tab formed at least in part from the side wall panel, the tab comprising:

an upper edge defined at least in part by a first cut line, the upper edge for engaging the underside of the flange; and an opposing lower edge defined at least in part by first and second fold lines; and a slit for receiving at least a portion of the flange, the slit being defined at least in part by the first cut line, and the slit having a width that is less that a thickness of the flange so as to cause the tab to pivot outwardly about said first and second fold lines with respect to the adjacent side wall panel when at least a portion of the flange is received in the slit;

wherein said first and second fold lines are arranged such that when the tab is pivoted outwardly the tab bows outwardly and the region of the adjacent side wall below the lower edge of the tab bows inwardly.

2. A carton according to claim 1 wherein the first and second fold lines are mutually divergent towards the upper edge of the tab.

3. A carton according to claim 1 wherein the upper edge is substantially aligned with a third fold line interconnecting the top panel with the side panel.

4. A carton according to claim 1 wherein the upper edge is offset from a third fold line interconnecting the top panel with the side panel.

5. A carton according to claim 4 wherein the top wall panel comprises a portion protruding outwardly of the third fold line to protect the article flange.

6. A carton according to claim 1 wherein a second cut line is provided intermediate the first and second fold lines.

7. A carton according to claim 6, wherein the first and second fold lines and the second cut line are arranged as a continuous curved section.

8. A carton according to claim 1 wherein a further fold line extends from the upper edge to one of the first and second fold lines.

9. A carton according to claim 1 wherein a cut line is provided intermediate the first and second fold lines.

10. A carton according to claim 1 wherein at least one second cut line extends from the top edge of the tab towards the bottom edge of the tab to facilitate the outwardly pivoting motion of the tab.

11. A carton according to claim 1 wherein second and third cut lines extend between the first cut line and a respective one of the first and second fold lines to define opposed side edges of the tab.

12. A package, comprising:

one or more articles having a laterally extending flange; and a carton comprising:

a top wall panel;

a side wall panel connected to the top wall panel; and an article retention structure comprising:

a tab formed at least in part from the side wall panel, the tab comprising:

an upper edge defined at least in part by a first cut line, the upper edge for engaging the underside of the flange; and an opposing lower edge defined at least in part by first and second fold lines; and a slit for receiving at least a portion of the flange, the slit being defined at least in part by the first cut line;

wherein at least a portion of the flange engages the tab so as to cause the tab to pivot outwardly about said first and second fold lines with respect to the adjacent side wall panel as at least a portion of the flange is received in the slit;

wherein the upper edge of the tab engages the underside of the flange to remain pivoted outwardly with respect to the adjacent side wall panel when the flange is received in the slit;

wherein said first and second fold lines are arranged such that when the tab is pivoted outwardly the tab bows outwardly and the region of the adjacent side wall below the lower edge of the tab bows inwardly.

* * * * *